US009772123B2

(12) United States Patent
McDonnell et al.

(10) Patent No.: US 9,772,123 B2
(45) Date of Patent: Sep. 26, 2017

(54) COOLING SYSTEMS AND METHODS INCORPORATING A PLURAL IN-SERIES PUMPED LIQUID REFRIGERANT TRIM EVAPORATOR CYCLE

(71) Applicant: Inertech IP LLC, Danbury, CT (US)

(72) Inventors: Gerald McDonnell, Poughquag, NY (US); Earl Keisling, Ridgefield, CT (US)

(73) Assignee: Inertech IP LLC, Danbury, CT (US)

( * ) Notice: Subject to any disclaimer, the term of this patent is extended or adjusted under 35 U.S.C. 154(b) by 231 days.

(21) Appl. No.: 14/682,772

(22) Filed: Apr. 9, 2015

(65) Prior Publication Data

US 2015/0211769 A1 Jul. 30, 2015

Related U.S. Application Data

(63) Continuation of application No. PCT/US2013/064186, filed on Oct. 9, 2013.
(Continued)

(51) Int. Cl.
*F25B 7/00* (2006.01)
*F25B 5/04* (2006.01)
(Continued)

(52) U.S. Cl.
CPC ..... *F25B 5/04* (2013.01); *F25B 6/02* (2013.01); *F25B 7/00* (2013.01); *F25B 25/005* (2013.01);
(Continued)

(58) Field of Classification Search
CPC ..... F25B 5/04; F25B 23/006; F25B 25/005; F25B 6/02; F25B 41/00; F25B 7/00
See application file for complete search history.

(56) References Cited

U.S. PATENT DOCUMENTS 5,715,693 A 2/1998 van der Walt et al.
6,116,048 A 9/2000 Hebert
(Continued)

FOREIGN PATENT DOCUMENTS

DE 102012218873 A1 5/2013
JP 2008287733 A 11/2008
JP 5308750 B2 10/2013

OTHER PUBLICATIONS

Weatherman: Automated, Online, and Predictive Thermal Mapping and Management for Data Centers; 2006; Justin Moore, Jeffrey S. Chase, Parthasarathy Ranganathan.
(Continued)

*Primary Examiner* — Len Tran
*Assistant Examiner* — Ana Vazquez
(74) *Attorney, Agent, or Firm* — Carter, DeLuca, Farrell & Schmidt, LLP

(57) ABSTRACT

Systems and methods relating to a plural in-series pumped liquid refrigerant trim evaporator cycle are described. The cooling systems include a first evaporator coil in thermal communication with an air intake flow to a heat load, and a first liquid refrigerant distribution unit in thermal communication with the first evaporator coil. The cooling systems further include a second evaporator coil disposed in series with the first evaporator coil in the air intake flow and in thermal communication with the air intake flow, and a second liquid refrigerant distribution unit in thermal communication with the second evaporator coil. A trim compression cycle of the second liquid refrigerant distribution unit is configured to further cool the air intake flow through the second evaporator coil when the temperature of the first fluid flowing out of the main compressor of the second liquid refrigerant distribution unit exceeds a predetermined threshold temperature.

16 Claims, 4 Drawing Sheets

Related U.S. Application Data

(60) Provisional application No. 61/711,736, filed on Oct. 9, 2012.

(51) Int. Cl.

| | |
|---|---|
| ***F25B 25/00*** | (2006.01) |
| ***F25B 41/00*** | (2006.01) |
| ***F25B 6/02*** | (2006.01) |
| ***F25B 49/02*** | (2006.01) |
| *F25B 23/00* | (2006.01) |

(52) U.S. Cl.
CPC ..... *F25B 41/00* (2013.01); *F25B 49/02* (2013.01); *F25B 23/006* (2013.01)

(56) References Cited

U.S. PATENT DOCUMENTS

| | | | |
|---|---|---|---|
| 6,374,627 | B1 | 4/2002 | Schumacher et al. |
| 6,574,104 | B2 | 6/2003 | Patel et al. |
| 6,640,561 | B2 | 11/2003 | Roberto |
| 6,772,604 | B2 | 8/2004 | Bash et al. |
| 6,826,922 | B2 | 12/2004 | Patel et al. |
| 6,859,366 | B2 | 2/2005 | Fink |
| 6,980,433 | B2 | 12/2005 | Fink |
| 7,046,514 | B2 | 5/2006 | Fink et al. |
| 7,106,590 | B2 | 9/2006 | Chu et al. |
| 7,173,820 | B2 | 2/2007 | Fink et al. |
| 7,406,839 | B2 | 8/2008 | Bean et al. |
| 7,418,825 | B1 | 9/2008 | Bean, Jr. |
| 7,477,514 | B2 | 1/2009 | Campbell et al. |
| 7,569,954 | B2 | 8/2009 | Tolle et al. |
| 7,660,116 | B2 | 2/2010 | Claassen et al. |
| 7,660,121 | B2 | 2/2010 | Campbell et al. |
| 7,684,193 | B2 | 3/2010 | Fink et al. |
| 7,730,731 | B1 | 6/2010 | Bash et al. |
| 7,738,251 | B2 | 6/2010 | Clidaras et al. |
| 7,757,506 | B2 | 7/2010 | Ellsworth, Jr. et al. |
| 7,804,687 | B2 | 9/2010 | Copeland et al. |
| 7,855,890 | B2 | 12/2010 | Kashirajima et al. |
| 7,864,527 | B1 | 1/2011 | Whitted |
| 7,881,057 | B2 | 2/2011 | Fink et al. |
| 7,903,404 | B2 | 3/2011 | Tozer et al. |
| 7,903,409 | B2 | 3/2011 | Patel et al. |
| 7,907,406 | B1 | 3/2011 | Campbell et al. |
| 7,957,144 | B2 | 6/2011 | Goettert et al. |
| 7,963,119 | B2 | 6/2011 | Campbell et al. |
| 8,000,103 | B2 | 8/2011 | Lipp et al. |
| 8,031,468 | B2 | 10/2011 | Bean, Jr. et al. |
| 8,118,084 | B2 | 2/2012 | Harvey |
| 8,120,916 | B2 | 2/2012 | Schmidt et al. |
| 8,146,374 | B1 | 4/2012 | Zien |
| 8,184,435 | B2 | 5/2012 | Bean, Jr. et al. |
| 8,189,334 | B2 | 5/2012 | Campbell et al. |
| 8,199,504 | B2 | 6/2012 | Kashirajima et al. |
| 8,208,258 | B2 | 6/2012 | Campbell et al. |
| 8,218,322 | B2 | 7/2012 | Clidaras et al. |
| 8,261,565 | B2 | 9/2012 | Borror et al. |
| 8,289,710 | B2 | 10/2012 | Spearing et al. |
| 8,297,069 | B2 | 10/2012 | Novotny et al. |
| 8,320,125 | B1 | 11/2012 | Hamburgen et al. |
| 8,351,200 | B2 | 1/2013 | Arimilli et al. |
| 8,387,687 | B2 | 3/2013 | Baer |
| 8,392,035 | B2 | 3/2013 | Patel et al. |
| 8,405,977 | B2 | 3/2013 | Lin |
| 8,432,690 | B2 | 4/2013 | Fink et al. |
| 8,456,840 | B1 | 6/2013 | Clidaras et al. |
| 8,457,938 | B2 | 6/2013 | Archibald et al. |
| 8,472,182 | B2 | 6/2013 | Campbell et al. |
| 8,514,575 | B2 | 8/2013 | Goth et al. |
| 8,583,290 | B2 | 11/2013 | Campbell et al. |
| 8,689,861 | B2 | 4/2014 | Campbell et al. |
| 8,760,863 | B2 | 6/2014 | Campbell et al. |
| 8,763,414 | B2 | 7/2014 | Carlson et al. |
| 8,780,555 | B2 | 7/2014 | Fink et al. |
| 8,783,052 | B2 | 7/2014 | Campbell et al. |
| 8,797,740 | B2 | 8/2014 | Campbell et al. |
| 8,813,515 | B2 | 8/2014 | Campbell et al. |
| 8,817,465 | B2 | 8/2014 | Campbell et al. |
| 8,817,474 | B2 | 8/2014 | Campbell et al. |
| 8,824,143 | B2 | 9/2014 | Campbell et al. |
| 8,839,638 | B2 | 9/2014 | Kashirajima et al. |
| 8,867,204 | B1 | 10/2014 | Gardner |
| 8,879,257 | B2 | 11/2014 | Campbell et al. |
| 9,072,201 | B2 | 6/2015 | Bean, Jr. |
| 2002/0172007 | A1 | 11/2002 | Pautsch |
| 2003/0061824 | A1 | 4/2003 | Marsala |
| 2005/0244277 | A1* | 11/2005 | Hurst, Jr. ..... F04B 49/065 417/216 |
| 2007/0227710 | A1 | 10/2007 | Belady et al. |
| 2009/0086428 | A1 | 4/2009 | Campbell et al. |
| 2009/0154096 | A1 | 6/2009 | Iyengar et al. |
| 2010/0032142 | A1 | 2/2010 | Copeland et al. |
| 2010/0136895 | A1 | 6/2010 | Sgro |
| 2010/0300650 | A1 | 12/2010 | Bean, Jr. |
| 2011/0198057 | A1 | 8/2011 | Lange et al. |
| 2011/0265983 | A1 | 11/2011 | Pedersen |
| 2011/0313576 | A1 | 12/2011 | Nicewonger |
| 2012/0012283 | A1 | 1/2012 | Bean, Jr. et al. |
| 2012/0103591 | A1 | 5/2012 | Tozer |
| 2012/0174612 | A1 | 7/2012 | Madara et al. |

OTHER PUBLICATIONS

Reduced-Order Modeling of Multiscale Turbulent Convection: Application to Data Center Thermal Management; May 2006, Jeffrey D. Rambo.

HP Modular Cooling System Site Preparation Guide; 2006-2007.

"Air-Cooled High-Performance Data Centers: Case Studies and Best Methods"; 2006; White Paper; Intel Information Technology.

Liebert Xtreme Density—System Design Manual, 2010.

Data Center Evolution; 2009; A Tutorial on State of the Art, Issues, and Challenges.

International Preliminary Report on Patentability for corresponding International Application No. PCT/US2013/064186, dated Apr. 23, 2015.

* cited by examiner

COOLING SYSTEMS AND METHODS INCORPORATING A PLURAL IN-SERIES PUMPED LIQUID REFRIGERANT TRIM EVAPORATOR CYCLE

BACKGROUND

Conventional cooling systems do not exhibit significant reductions in energy use in relation to decreases in load demand. Air-cooled direct expansion (DX), water-cooled chillers, heat pumps, and even large fan air systems do not scale down well to light loading operation. Rather, the energy cost per ton of cooling increases dramatically as the output tonnage is reduced on conventional systems. This has been mitigated somewhat with the addition of fans, pumps, and chiller variable frequency drives (VFDs); however, their turn-down capabilities are still limited by such issues as minimum flow constraints for thermal heat transfer of air, water, and compressed refrigerant. For example, a 15% loaded air conditioning system requires significantly more than 15% power of its 100% rated power use. In most cases, such a system requires as much as 40-50% of its 100% rated power use to provide 15% of cooling work.

Conventional commercial, residential, and industrial air conditioning cooling circuits require high electrical power draw when energizing the compressor circuits to perform the cooling work. Some compressor manufacturers have mitigated the power inrush and spikes by employing energy saving VFDs and other apparatuses for step loading control functions. However, the current systems employed to perform cooling functions are extreme power users.

Existing refrigerant systems do not operate well under partially-loaded or lightly-loaded conditions, nor are they efficient at low temperature or "shoulder seasonal" operation in cooler climates. These existing refrigerant systems are generally required to be fitted with low ambient kits in cooler climates and other energy robbing circuit devices, such as hot gas bypass, in order to provide a stable environment for the refrigerant under these conditions.

Compressors on traditional cooling systems rely on tight control of the vapor evaporated in an evaporator coil. This is accomplished by using a metering device (or expansion valve) at the inlet of the evaporator which effectively meters the amount of liquid that is allowed into the evaporator. The expanded liquid absorbs the heat present in the evaporator coil and leaves the coil as a super-heated vapor. Tight metering control is required to ensure that all of the available liquid has been boiled off before leaving the evaporator coil. This can create several problems under low loading conditions, such as uneven heat distribution across a large refrigerant coil face or liquid slugging to the compressor, which can damage or destroy a compressor.

To combat the inflexibility problems that exist on the low-end operation of refrigerant systems, manufacturers employ hot gas bypass and other low ambient measures to mitigate slugging and uneven heat distribution. These measures create a false load and cost energy to operate.

Conventional air-cooled air conditioning equipment are inefficient. The kw per ton (kilowatt electrical per ton of refrigeration or kilowatt electrical per 3.517 kilowatts of refrigeration) for the circuits are more than 1.0 kw per ton during operation in high dry bulb ambient conditions.

Evaporative assist condensing air conditioning units exhibit better kw/ton energy performance over air-cooled direct-expansion (DX) equipment. However, they still have limitations in practical operation in climates that are variable in temperature. They also require a great deal more in maintenance and chemical treatment costs.

Central plant chiller systems that temper, cool, and dehumidify large quantities of hot process intake air, such as intakes for turbine inlet air systems, large fresh air systems for hospitals, manufacturing, casinos, hotel, and building corridor supply systems are expensive to install, costly to operate, and are inefficient over the broad spectrum of operational conditions.

Existing compressor circuits have the ability to reduce power use under varying or reductions in system loading by either stepping down the compressors or reducing speed (e.g., using a VFD). However, there are limitations to the speed controls as well as the steps of reduction.

Gas turbine power production facilities rely on either expensive chiller plants and inlet air cooling systems or high volume water spray systems to temper the inlet combustion air. The turbines lose efficiency when the entering air is allowed to spike above 15° C. and possess a relative humidity (RH) of less than 60% RH. The alternative to the chiller plant assist is a high volume water inlet spray system. High volume water inlet spray systems are less costly to build and operate. However, such systems present heavy maintenance costs and risks to the gas turbines, as well as consume huge quantities of potable water.

Hospital intake air systems require 100% outside air. It is extremely costly to cool this air in high ambient and high latent atmospheres using the conventional chiller plant systems.

Casinos require high volumes of outside air for ventilation to casino floors. They are extremely costly to operate and utilize a tremendous amount of water, especially in arid environments, e.g., Las Vegas, Nev. in the United States.

Middle eastern and desert environments have a high impact on inlet air cooling systems due to the excessive work that a compressor is expected to perform as a ratio of the inlet condensing air or water versus the leaving chilled water discharge. The higher the ratio, the more work the compressor has to perform with a resulting higher kw/ton electrical draw. As a result of the high ambient desert environment, a cooling plant will expend nearly double the amount of power to produce the same amount of cooling in a less arid environment.

High latent load environments, such as in Asia, India, Africa, and the southern hemispheres, require high cooling capacities to handle the effects of high moisture in the atmosphere. The air must be cooled and the moisture must be eliminated to provide comfort cooling for residential, commercial, and industrial outside air treatment applications. High latent heat loads cause compressors to work harder and require a higher demand to handle the increased work load.

Existing refrigeration process systems are normally designed and built in parallel. The parallel systems do not operate efficiently over the broad spectrum of environmental conditions. They also require extensive control algorithms to enable the various pieces of equipment on the system to operate as one efficiently. There are many efficiencies that are lost across the operating spectrum because the systems are piped, operated, and controlled in parallel.

Each conventional air conditioning system exhibits losses in efficiency at high-end, shoulder, and low-end loading conditions. In addition to the non-linear power versus loading issues, environmental conditions have extreme impacts on the individual cooling processes. The conventional systems are too broadly utilized across a wide array of environmental conditions. The results are that most of the systems operate inefficiently for a majority of the time. The reasons for the inefficiencies are based on operator misuse, misapplication for the environment, or losses in efficiency due to inherent limiting characteristics of the cooling equipment.

SUMMARY

In one aspect, the present disclosure features a cooling system including a first evaporator coil in thermal communication with an air intake flow to a heat load, a first liquid refrigerant distribution unit in thermal communication with the first evaporator coil, a second evaporator coil disposed in series with the first evaporator coil in the air intake flow and in thermal communication with the air intake flow to the heat load, a second liquid refrigerant distribution unit in thermal communication with the second evaporator coil, and a fluid cooler for free cooling a first fluid circulating through the first and second liquid refrigerant distribution units. The trim compression cycle of the second liquid refrigerant distribution unit is configured to incrementally further cool the air intake flow through the second evaporator coil when the temperature of the free-cooled first fluid flowing out of the second liquid refrigerant distribution unit exceeds a predetermined temperature.

The first evaporator coil may be disposed downstream from the second evaporator coil in the air intake flow.

The predetermined temperature may be the maximum temperature needed to bring the temperature of the air intake flow out of the second evaporator down to a desired temperature.

The first liquid refrigerant distribution unit may include a third evaporator in fluid communication with a fluid cooler to enable the transfer of heat from a first fluid flowing from the fluid cooler to a second fluid flowing through the third evaporator, a main condenser in fluid communication with the first and third evaporators to enable the transfer of heat from a third fluid flowing from the first evaporator to the first fluid flowing from the third evaporator, and a trim condenser in fluid communication with the main condenser and the third evaporator to enable the transfer of heat from the second fluid flowing from the third evaporator to the first fluid flowing from the main condenser.

The first liquid refrigerant distribution unit may further include a compressor in fluid communication with a fluid output of the third evaporator and a fluid input of the trim condenser, and an expansion valve in fluid communication with a fluid output of the trim condenser and a fluid input of the third evaporator. The first liquid refrigerant distribution unit may further include a fluid receiver in fluid communication with a fluid output of the main condenser, and a fluid pump in fluid communication with a fluid output of the fluid receiver and a fluid input of the first evaporator. The first fluid may be water, the second fluid may be a first refrigerant, and the third fluid may be a second refrigerant.

The second liquid refrigerant distribution unit may include a fourth evaporator in fluid communication with the fluid cooler to enable the transfer of heat from a first fluid flowing from the fluid cooler to a fourth fluid flowing through the fourth evaporator, a second main condenser in fluid communication with the second and fourth evaporators to enable the transfer of heat from the fourth fluid flowing from the second evaporator to the first fluid flowing from the fourth evaporator, and a second trim condenser in fluid communication with the second main condenser and the fourth evaporator to enable the transfer of heat from the fourth fluid flowing from the fourth evaporator to the first fluid flowing from the second main condenser. The first fluid may be a water-based solution, the second fluid may be a first refrigerant, and the fourth fluid may be a second refrigerant. The second liquid refrigerant distribution unit may further include a second fluid receiver in fluid communication with an output of the second main condenser, and a second fluid pump in fluid communication with a fluid output of the second fluid receiver and a fluid input of the second evaporator.

The second liquid refrigerant distribution unit may alternatively include a third condenser in fluid communication with the fluid cooler to enable the transfer of heat from a first fluid flowing from the fluid cooler to a fourth fluid flowing through the third condenser, and a third evaporator in fluid communication with the third condenser and the second evaporator to enable the transfer of heat from a fifth fluid flowing from the second evaporator to the fourth fluid flowing from the third condenser. The second liquid refrigerant distribution unit may further include a second expansion valve in fluid communication with a fluid output of the third condenser and a fluid input of the third evaporator, and a second compressor in fluid communication with a fluid output of the third evaporator and a fluid input of the third condenser to form a second trim compression cycle. The second liquid refrigerant distribution unit may further include a second fluid receiver in fluid communication with a fluid output of the third evaporator, and a second fluid pump in fluid communication with a fluid output of the second fluid receiver and a fluid input of the second evaporator.

In another aspect, the present disclosure features a method of operating a cooling system. The method includes pumping a first refrigerant through a first evaporator coil in thermal communication with an air intake flow to a heat load, pumping a free-cooled fluid through a first liquid refrigerant distribution unit in thermal communication with the first refrigerant flowing through the first evaporator coil, pumping a second refrigerant through a second evaporator coil disposed in series with the first evaporator coil in thermal communication with the air intake flow downstream from the first evaporator coil, pumping a free-cooled fluid through a second liquid refrigerant distribution unit in thermal communication with the second refrigerant flowing through the second evaporator coil, determining whether the temperature of the free-cooled fluid flowing out of a condenser of the second liquid refrigerant distribution unit is greater than a predetermined temperature threshold, and turning on a trim compression cycle of the second liquid refrigerant distribution unit if it is determined that the temperature of the free-cooled fluid flowing out of the condenser of the second liquid refrigerant distribution unit is greater than the predetermined temperature threshold.

The predetermined threshold temperature may be determined based on the temperature of the free-cooled fluid flowing out of the condenser of the second liquid refrigerant distribution unit that cannot fully condense the second refrigerant back to a liquid.

The method may further include incrementally changing the heat load capacity of the trim compression cycle of the second liquid refrigerant distribution unit as outside environmental conditions change. Alternatively, the method may further include incrementally increasing the heat load capacity of the trim compression cycle as the wet bulb temperature of the outside environment increases.

In yet another aspect, the present disclosure features a cooling system including a first evaporator coil in thermal communication with an air intake flow to a heat load, a first liquid refrigerant distribution unit in thermal communication with the first evaporator coil, a second evaporator coil disposed in series with the first evaporator coil in the air intake flow and in thermal communication with the air intake flow to the heat load, a second liquid refrigerant distribution unit in thermal communication with the second evaporator coil, a fluid cooler for free cooling a first fluid, and a fluid pump for circulating the first fluid through the first and second liquid refrigerant distribution units. The trim compression cycle of the second liquid refrigerant distribution unit incrementally further cools the air intake flow through the second evaporator coil when the temperature of the free-cooled first fluid flowing out of a condenser of the second liquid refrigerant distribution unit exceeds a predetermined temperature.

DETAILED DESCRIPTION

The dual pumped liquid refrigerant system of the present disclosure includes circuits that are intended to operate either alone or in series. The primary circuit implements a free cooling water-cooled pumped refrigerant process with an in-series trim refrigerant circuit that is capable of trimming the entering condenser process water. The refrigerant trim process is only energized when the outside environmental conditions (e.g., wet bulb conditions) cannot fully condense the refrigerant back to a liquid at a given condenser setpoint.

The secondary circuit is a similar circuit to the primary circuit. It is intended to provide supplemental trim cooling when the primary circuit cannot sufficiently handle the load on its own. The dual circuits can also be operated in a non-compression primary and back-up compression secondary operation for greater overall combined system efficiencies. When operating the circuits in tandem, the effective compressor load is reduced by more than 50-70%.

Additionally, because the refrigerant circuits are in series, the "lift" of the compressor is greatly reduced, which enables the compressor to operate at a highly efficient kw per ton. This reduction in kw per ton can be at least ten times more efficient than an air-cooled system plant, and at least four times more efficient than a compressor operating on a traditional water-cooled plant. The process heat that is generated by this cycle is intended to be transported and rejected to the atmosphere using a fluid cooler, cooling tower 3000, or other heat rejection apparatus.

Figure 1:
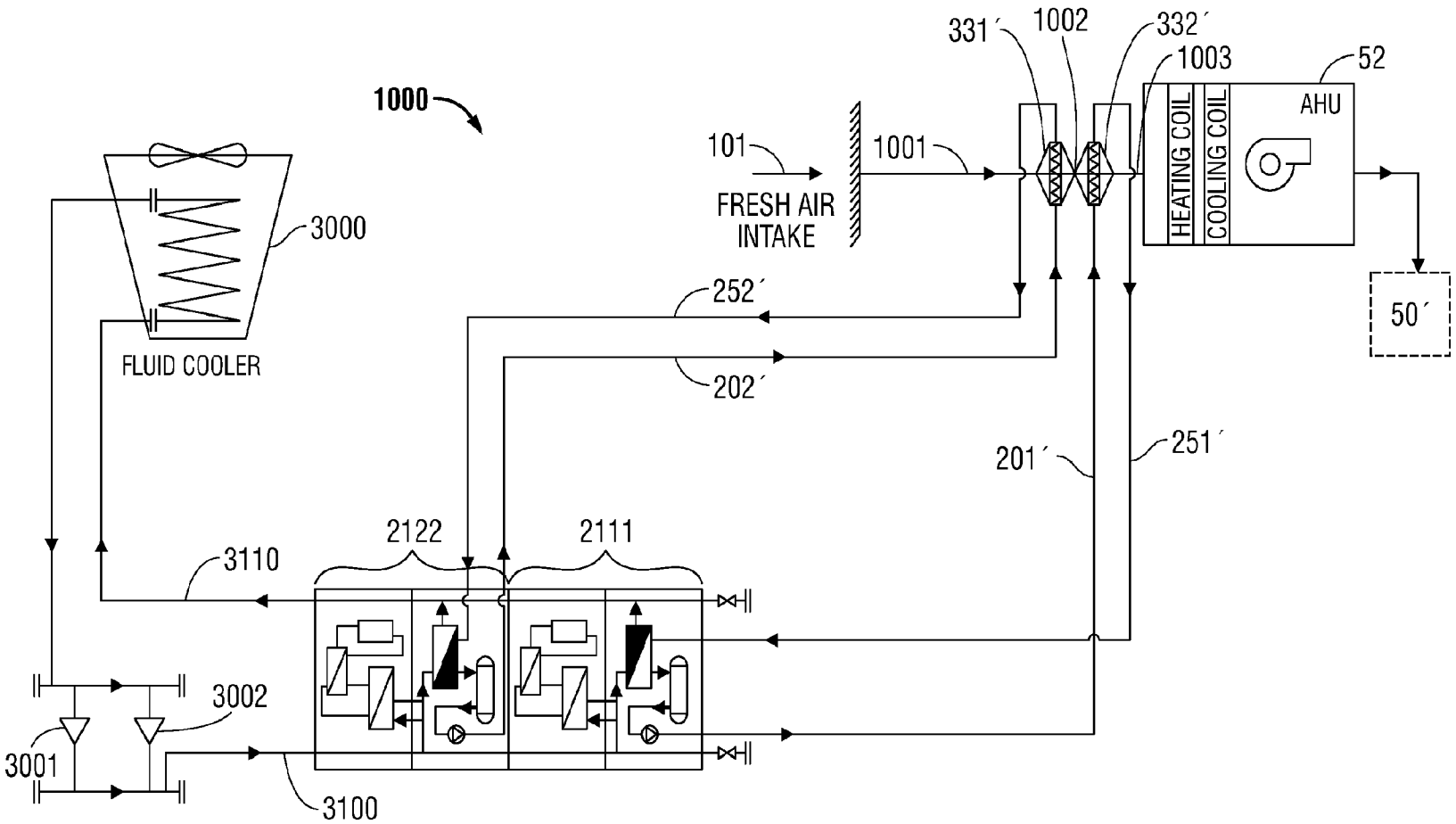
FIG. 1 is a schematic flow diagram of a cooling system using a dual pumped liquid refrigerant system according to embodiments of the present disclosure that includes a primary evaporator and a secondary evaporator in thermal communication with a cooling air flow to a heat load.

FIG. 1 illustrates a dual pumped liquid refrigerant system 1000 according to embodiments of the present disclosure that includes a primary evaporator 331' and a secondary evaporator 332' in direct contact with cooling air flowing through a fresh air intake 101 to a heat load 50' that is downstream of an air handling unit (AHU) 52. The dual pumped liquid refrigerant system 1000 is suitable for low wet bulb environments.

The flow of cooling air is directed to the air handling unit 52 from the fresh air intake 101 through cooling air conduits 1001, 1002, and 1003. The first cooling air conduit 1001 provides fluid communication between the fresh air intake 101 to a secondary evaporator coil 332'. Upon flowing through the secondary evaporator coil 332', the cooling air is directed through second air flow conduit 1002 to primary evaporator coil 331' to provide fluid communication between the primary and secondary evaporator coils 331' and 332', respectively. Upon flowing through the primary evaporator coil 331', the cooling air is directed through third air flow conduit 1003 to provide fluid communication with the air handling unit 52 and the heat load 50'.

The primary evaporator coil 331' is in fluid communication with a primary liquid refrigerant pumped circuit or distribution unit 2111 via liquid refrigerant supply header 201' and liquid refrigerant return header 251'.

Similarly, the secondary evaporator coil 332' is in fluid communication with a secondary liquid refrigerant pumped circuit or distribution unit 2122 via liquid refrigerant supply header 202' and liquid refrigerant return header 252'.

The primary and secondary liquid refrigerant pumped circuits or distribution units 2111 and 2122, are each supplied cooling water via a common cooling water supply header 3100. Upon transferring heat from the primary and secondary liquid refrigerant pumped circuits or distribution units 2111 and 2122, the cooling water is discharged to a cooling tower 3000 via a common cooling water return header 3110. Via the fluid communication between the cooling air flowing through the air conduits 1001, 1002, and 1003 from the fresh air intake 101, the primary and secondary evaporator coils 331' and 332', and the primary and secondary liquid refrigerant pumped circuit or distribution units 2111 and 2122, the cooling air flowing through the air conduits 1001, 1002 and 1003 from the fresh air intake 101 is thereby in thermal communication with the cooling tower 3000.

The heat removal from the cooling air flowing through the air conduits 1001, 1002, and 1003 is rejected to the environment via the cooling tower 3000. Cooling fluid pumps 3001 and 3002 are disposed in the common cooling water return header 3110 to provide forced circulation flow of the cooling fluid, generally water, from the cooling tower 3000 to the primary and secondary liquid refrigerant pumped circuit or distribution units 2111 and 2122, respectively.

Figure 2:
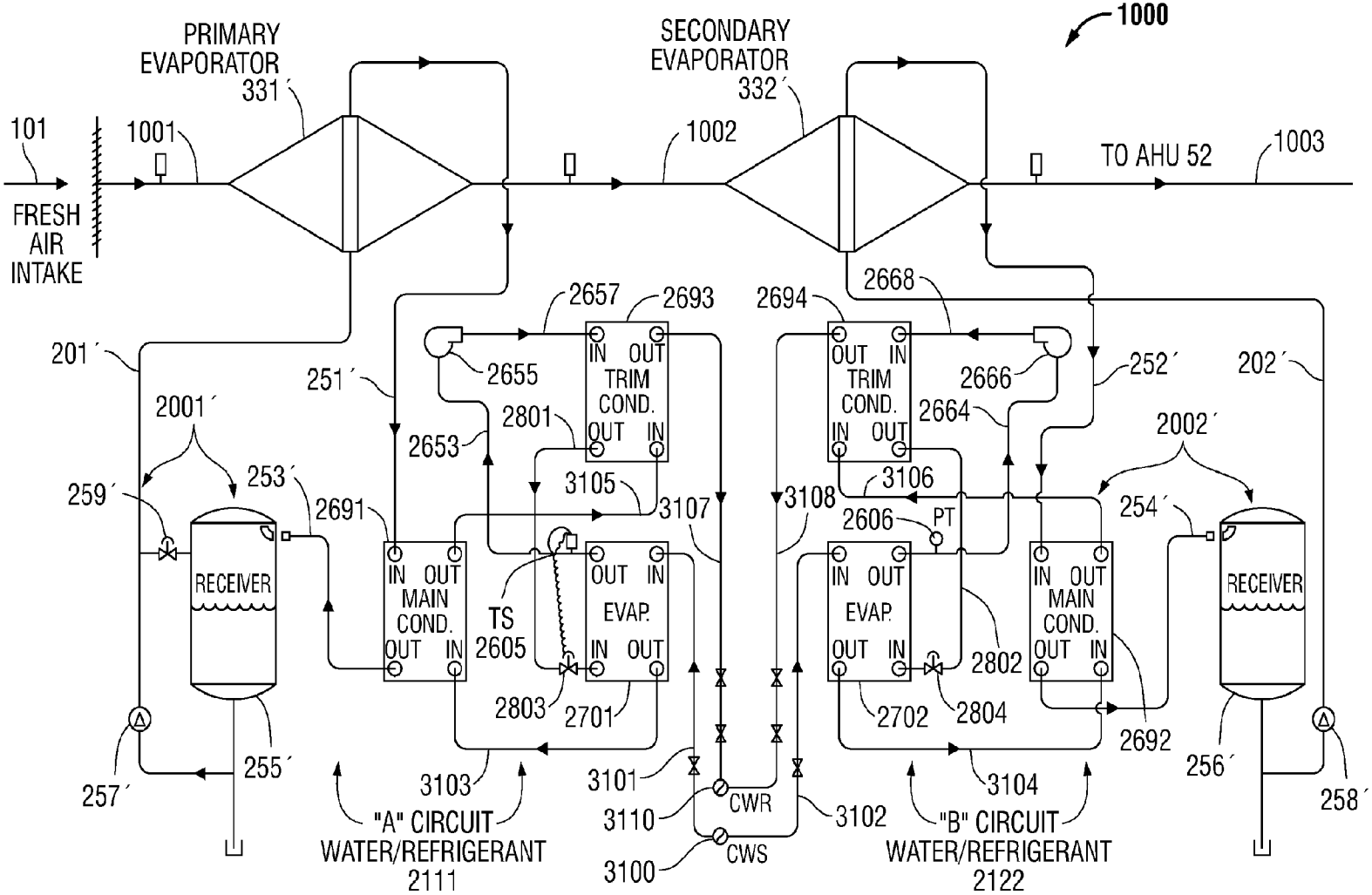
FIG. 2 is a schematic flow diagram illustrating the dual pumped liquid refrigerant system according to FIG. 1, where the system includes two individual pumped liquid refrigerant circuits associated with the respective primary and secondary evaporators.

Turning now to FIG. 2, primary and secondary liquid refrigerant pumped circuits or distribution units 2111 and 2122 include primary evaporator coil 331' and secondary evaporator coil 332' that are supplied and return liquid refrigerant via first liquid refrigerant assist cycle supply headers 201' and 202' and first liquid refrigerant assist cycle return headers 251' and 252', respectively, from first and second liquid refrigerant assist circuits 2001' and 2002', respectively.

First liquid refrigerant assist cycle return headers 251' and 252' return to main condensers 2691 and 2692, respectively, through which the at least partially vaporized liquid refrigerant is condensed and returned to the liquid receivers 255' and 256' via evaporator to liquid receiver supply lines 253' and 254'. A minimum level of liquid refrigerant is maintained in the receivers 255' and 256'. Liquid refrigerant in the receivers 255' and 256' is in fluid communication with the suction side of liquid refrigerant pumps 257' and 258' and is discharged as a pumped liquid via the liquid refrigerant pumps 257' and 258' to the primary evaporator 331' and secondary evaporator 332' via the liquid refrigerant assist cycle supply headers 201' and 202', respectively. To ensure minimum recirculation flow in the receivers 255' and 256', at least the receiver 255' may include a bypass control valve 259' that provides fluid communication between the liquid refrigerant assist cycle supply header 201' on the discharge side of liquid refrigerant pump 257' and the receiver 255'.

The main condensers 2691 and 2692 are in thermal and fluid communication with trim condensers 2693 and 2694, and with evaporators 2701 and 2702, respectively, in the following manner. Cooling water supplied from the common cooling water supply header 3100 is supplied in series via cooling water supply to evaporator conduit lines 3101 and 3102 first to evaporators 2701 and 2702, then to main condensers 2691 and 2692 via evaporator to main condenser cooling water conduit lines 3103 and 3104, then to trim condensers 2693 and 2694 via main condenser to trim condenser cooling water conduit lines 3105 and 3106, and then from trim condensers 2693 and 2694 back to cooling water return header 3110 via trim condenser to return header cooling water conduit lines 3107 and 3108, respectively.

In each of the primary and secondary liquid refrigerant pumped circuit or distribution units 2111 and 2122, a second liquid refrigerant is in thermal and fluid communication with the respective evaporators 2701 and 2702 and with the respective trim condensers 2693 and 2694 in the following manner. When the trim condensers 2693 and 2694 are in operation, the second liquid refrigerant, in an at least partially vaporized state, is transported from the evaporators 2701 and 2702 at the refrigerant outlet to the suction of trim condenser compressors 2655 and 2666 via evaporator to trim condenser compressor second liquid refrigerant conduit lines 2653 and 2664, respectively.

The second liquid refrigerant is discharged from the trim condenser compressors 2655 and 2666 as a high pressure gas and transported from the trim condenser compressors 2655 and 2666 to the trim condensers 2693 and 2694 via trim condenser compressor to trim condenser second refrigerant conduit lines 2657 and 2668, respectively. Upon transferring heat in the trim condensers 2693 and 2694 to the cooling water flowing through the trim condensers via the cooling water conduit lines 3105, 3106, 3107, and 3108 back to the cooling water return header 3110, the high pressure gas is condensed in the trim condensers 2693 and 2694 and transported as a liquid refrigerant from the trim condensers 2693 and 2694 to the refrigerant inlet of evaporators 2701 and 2702 via trim condenser to evaporator liquid refrigerant lines 2801 and 2802, respectively.

As shown in the primary liquid refrigerant distribution unit 2111 of FIG. 2, a temperature switch or sensor TS 2605 may be disposed in evaporator to trim condenser compressor conduit line 2653 and may be used to control a liquid refrigerant expansion valve 2803 disposed in trim condenser to evaporator conduit line 2801 to control the flow of cold gas to the evaporator 2701. Similarly, as shown in the secondary liquid refrigerant distribution unit 2122, a pressure and temperature sensor PT 2606 may be disposed in the evaporator to trim condenser compressor conduit line 2664 and may be used to control a liquid refrigerant expansion valve 2804 disposed in trim condenser to evaporator conduit line 2802 to control the flow of cold gas to the evaporator 2702.

Thus, cooling water is supplied in series to the evaporators 2701 and 2702, to the main condensers 2691 and 2692, and to the trim condensers 2693 and 2694. The system 1000 may be operated in various modes depending upon the heat load presented by the fresh air at fresh air intake 101. That is, operation may range from the minimum operational state of the primary evaporator 331' in operation with the liquid receiver 255' and main condenser 2691. If conditions warrant, the trim condenser 2693 may be placed into operation in conjunction with operation of the trim condenser compressor 2655.

Again, if conditions warrant, the secondary evaporator 332' may be placed into operation with the same operational sequence applied. If the heat load decreases, the cooling operation may be reduced in the opposite sequence beginning with reduction of the secondary evaporator 332' cooling followed by reduction of the primary evaporator 331' cooling or even beginning with reduction of the primary evaporator 331' cooling.

In the exemplary embodiments of FIGS. 1 and 2, the primary liquid refrigerant distribution unit 2111 and the secondary liquid refrigerant distribution unit 2122 are functionally mirror images or duplicates of each other. That is to say, although the capacity and sizing of the secondary evaporation coil 332' and secondary liquid refrigerant distribution unit 2122 are generally the same as the capacity and sizing of the primary evaporation coil 331' and primary liquid refrigerant distribution unit 2111, respectively, the capacity and sizing may differ one from the other, depending on the particular design requirements or choices. The first liquid refrigerant assist circuit 2001' is dedicated to, and in fluid communication with, the first evaporation coil 331', while the second liquid refrigerant assist circuit 2002' is dedicated to, and in fluid communication with, the second evaporation coil 332'.

Accordingly, the first and second evaporation coils 331' and 332' are in fluid communication with the first and second liquid refrigerant assist circuits 2001' and 2002' via first liquid refrigerant assist cycle supply headers 201', 202' and first liquid refrigerant assist cycle return headers 251', 252', respectively.

For some environments, the primary liquid refrigerant distribution unit 2111 may not include the evaporator 2701, the expansion valve 2803, the compressor 2655, or the trim condenser 2693. That is, the main condenser 2691 may be in direct fluid communication with the common cooling water supply header 3100 and the cooling water return header 3110 so that cooling water flows from the common cooling water supply header 3100, through the main condenser 2691, and back to the cooling water return header 3110.

Figure 3:
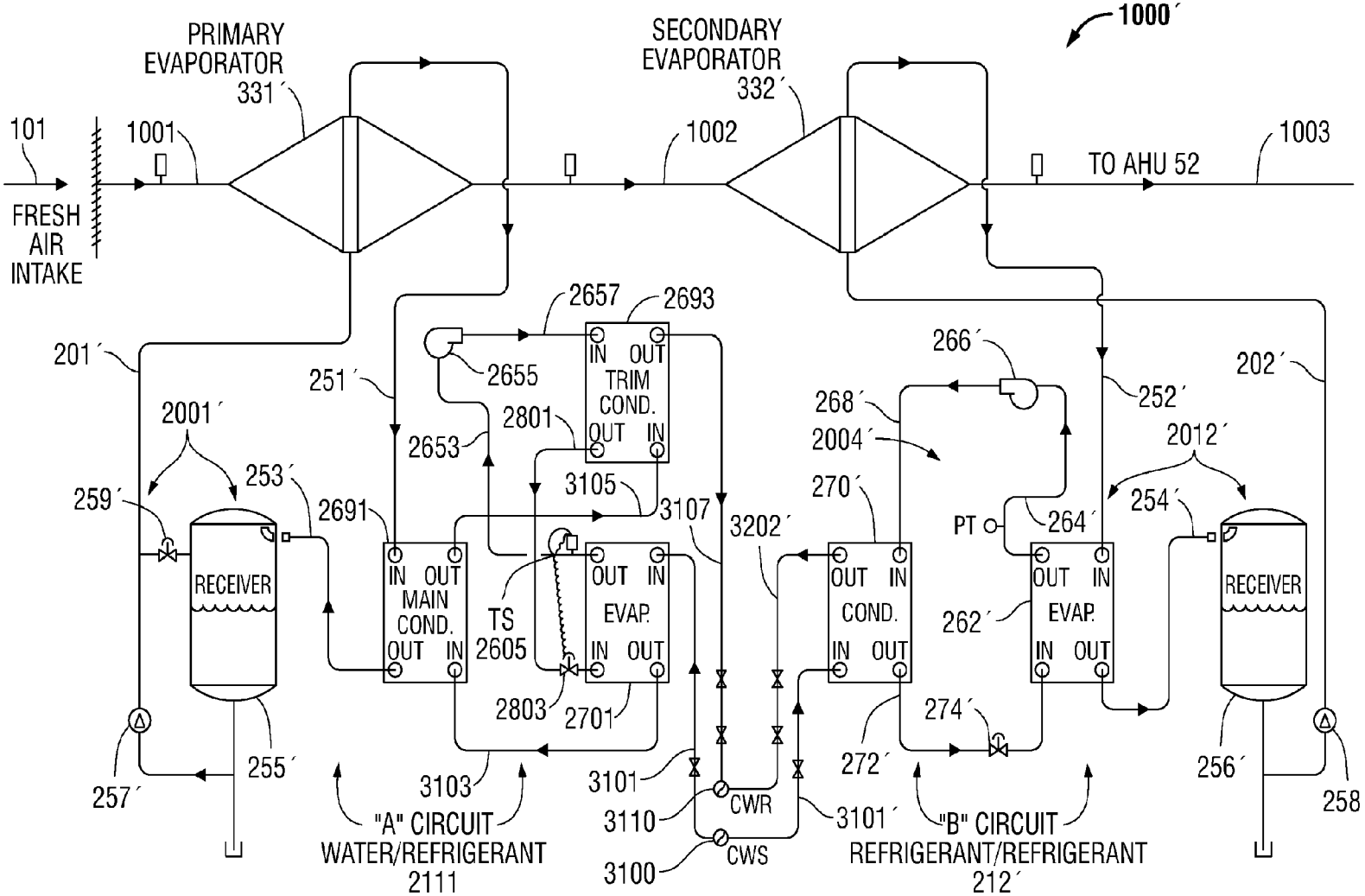
FIG. 3 is a schematic flow diagram of an alternate embodiment of the dual pumped liquid refrigerant system of FIG. 2, which includes a second liquid refrigerant circuit associated with the secondary evaporator having a refrigerant-to-refrigerant heat exchanger in lieu of a water-to-refrigerant heat exchanger of a first liquid refrigerant circuit associated with the primary evaporator.

FIG. 3 is a schematic flow diagram that is similar to the schematic of FIG. 2. The differences are in the secondary circuit. The secondary cooling circuit possesses a refrigerant-to-refrigerant heat exchanger in lieu of the water-to-refrigerant heat exchanger. This is more beneficial in high wet bulb environments. This is a cooling system that exhibits greatly improved cooling production to power use ratios over a broad spectrum of environmental conditions and system loading.

FIG. 3 indicates two cycles: the first cycle is a plural water-to-refrigerant pumped solution which is best utilized in low to moderate wet bulb conditions (below 24° C. wet bulb). The cycle illustrated in FIG. 3 is optimized for use in environments that incur higher wet bulb spikes. Under both systems illustrated in FIGS. 2 and 3, the cycles enable a heat absorption process that is performed in steps or stages. The primary heat absorption is performed at the primary evaporator. In some embodiments, depending on the environment and the desired cooling requirements (e.g., ultimate discharge air temperature), the primary evaporator cycle can absorb as much as 50%-70% of the incoming present cooling load at approximately 10% of the power use that would normally be required in a compressor cycle.

The balance of the load can be cooled by either utilizing the primary trim compressor (on the primary evaporator circuit) or by staging further cooling downstream at the secondary evaporator circuit. The resultant load that remains to be cooled in the secondary circuit (if there is any) can be handled at a greatly reduced capacity. By staging the heat rejection process utilizing a pumped refrigerant circuit as a primary means of cooling, the power to cooling capacity ratio is effectively reduced by as much as 90% for the primary or initial stage of cooling, and the further (secondary staged) or incremental cooling reduces the total power required by as much as 77% as compared to a conventional chiller plant system to cool fresh air intake systems, thereby optimizing effects of latent heat of vaporization so as to supplant traditional compressed refrigerant cooling systems for many applications.

FIG. 3 illustrates an alternate embodiment of the dual-pumped liquid refrigerant system 1000 of FIGS. 1 and 2 that includes circuits that are intended to operate either alone or in series. The dual-pumped liquid refrigerant system 1000' differs from dual-pumped liquid refrigerant-system 1000 in that the secondary liquid refrigerant pumped circuit or distribution unit 2122 is replaced by secondary liquid refrigerant pumped circuit or distribution unit 212'.

Cooling water is supplied to secondary liquid refrigerant pumped circuit or distribution unit 212' via the cooling tower 3000 and the common cooling water supply header 3100 and common cooling water return header 3110.

Generally speaking, although the capacity and sizing of the second evaporation coil 332' and second liquid refrigerant distribution unit 212' are the same as the capacity and sizing of the first evaporation coil 331' and first liquid refrigerant distribution unit 2111, the capacity and sizing may differ one from the other, depending on the particular design requirements or choices. The first liquid refrigerant assist circuit 2001' is dedicated to, and in fluid communication with, the first evaporation coil 331', while second liquid refrigerant assist circuit 2012' is dedicated to, and in fluid communication with, the second evaporation coil 332'.

Accordingly, the first and second evaporation coils 331' and 332' are again in fluid communication with the first and second liquid refrigerant assist circuits 2001' and 2012' via first liquid refrigerant assist cycle supply headers 201' and 202' and first liquid refrigerant assist cycle return headers 251' and 252', respectively.

As liquid refrigerant is supplied to first and second evaporation coils 331' and 332' via the first liquid refrigerant assist cycle supply headers 201' and 202', the liquid refrigerant is at least partially vaporized by transfer of heat from the first and second evaporation coils 331' and 332' such that at least partially vaporized refrigerant in the form of a gas or a gas and liquid refrigerant mixture is returned via liquid refrigerant assist circuit return headers 251' and 252' to evaporators 2701 and 262', included within first and second liquid refrigerant assist circuits 2001' and 2012', respectively.

As the process for transferring heat from the primary evaporator 331' to the cooling tower 3000 via first liquid refrigerant distribution unit 2111 is the same as described above with respect to FIGS. 1 and 2, the following description is generally directed to describing the process for transferring heat from the secondary evaporator 332' to the cooling tower 3000 via secondary liquid refrigerant distribution unit 2122.

Accordingly, within the evaporator 262', heat is transferred from the gas or gas and liquid refrigerant mixture such that condensation of the liquid refrigerant occurs within the evaporator 262' and liquid refrigerant is discharged via evaporator to liquid receiver supply line 254' to liquid receiver 256'. The liquid refrigerant receiver 256' is operated to maintain a supply of liquid refrigerant on the suction side of liquid refrigerant pump 258', which discharges liquid refrigerant into the liquid refrigerant assist cycle supply header 202' to supply liquid refrigerant again to the evaporation coil 332'.

Thus, the liquid refrigerant distribution unit 212' is in thermal communication with the fresh air intake air flow through the second and third air conduits 1002 and 1003 and the secondary evaporation coil 332', and is configured to circulate a second fluid, i.e., the first liquid refrigerant flowing in the first liquid refrigerant assist cycle supply header 202' and first liquid refrigerant assist circuit return header 252', thereby enabling heat transfer from the intake air flow at 101 to the first liquid refrigerant.

The circulation or flow of a first liquid refrigerant from the evaporators 2701 and 262' to the evaporator coils 331' and 332' via the liquid refrigerant pumps 257' and 258' and the liquid receivers 255' and 256', and back to the main condenser 2691 and evaporator 262' as a gas or a gas and liquid refrigerant mixture, define first liquid refrigerant circuits 2001' and 2012', respectively.

Heat is transferred within the evaporator 262' from the condensation side represented by the flow of the gas or gas and liquid refrigerant mixture in the liquid refrigerant assist circuit return header 252' to the liquid refrigerant assist cycle supply header 202', to the trim evaporation side of the evaporator 262'. The trim evaporation side is represented by the flow to the evaporator 262' of a second liquid refrigerant flowing in the second liquid refrigerant circuit or trim compressor circuit 2004' of the second liquid refrigerant distribution unit 212'.

The trim evaporation side is also represented by the second liquid refrigerant circuit 2004', in which a second liquid refrigerant is circulated from the evaporator 262' to the condenser 270' such that the second refrigerant is received in liquid form from the condenser 270' via the second refrigerant condenser to the evaporator supply line 274'. The second refrigerant in liquid form is then evaporated in the evaporator 262' via the transfer of heat from the first liquid refrigerant circuit 2012' side of the evaporator 262'.

The at least partially evaporated second refrigerant, evaporated via a trimming method, flows or circulates from the evaporator 262' to the suction side of trim compressor 266' via evaporator to compressor suction connection line 264'. The trim compressor 266' compresses the at least partially evaporated second refrigerant to a high pressure gas. For example, the compressed high pressure gas may have a pressure range of approximately 135-140 psia (pounds per square inch absolute).

The high pressure second refrigerant gas circulates from the discharge side of compressor 266' to the condenser side of condenser 270' via compressor discharge to condenser connection line 268'. Heat is transferred from the condenser side of condenser 270' to the water side of the condenser 270'. Cooling water supplied from the common cooling water supply header 3100 is supplied to the water side of condenser 270' via cooling water supply to condenser conduit line 3101'. The cooling water is then returned from condenser 270' back to cooling water return header 3110 via condenser to return header cooling water conduit line 3202'.

Cooling the intake air occurs by sequentially and incrementally operating the primary evaporator cooling coil 331' and the secondary evaporator cooling coil 332' in the same manner as the sequential and incremental operation of primary evaporator cooling coil 331' and secondary evaporator cooling coil 332' described above with respect to FIG. 2.

Those skilled in the art will recognize and understand that the secondary liquid refrigerant pumped circuit or distribution unit 212' for cooling of the fresh air intake via secondary evaporator 332' may be operated in an incremental manner in conjunction with the operation of the primary liquid refrigerant pumped circuit or distribution unit 2111 for cooling the fresh air intake via primary evaporator 331' as described above.

Figure 4:
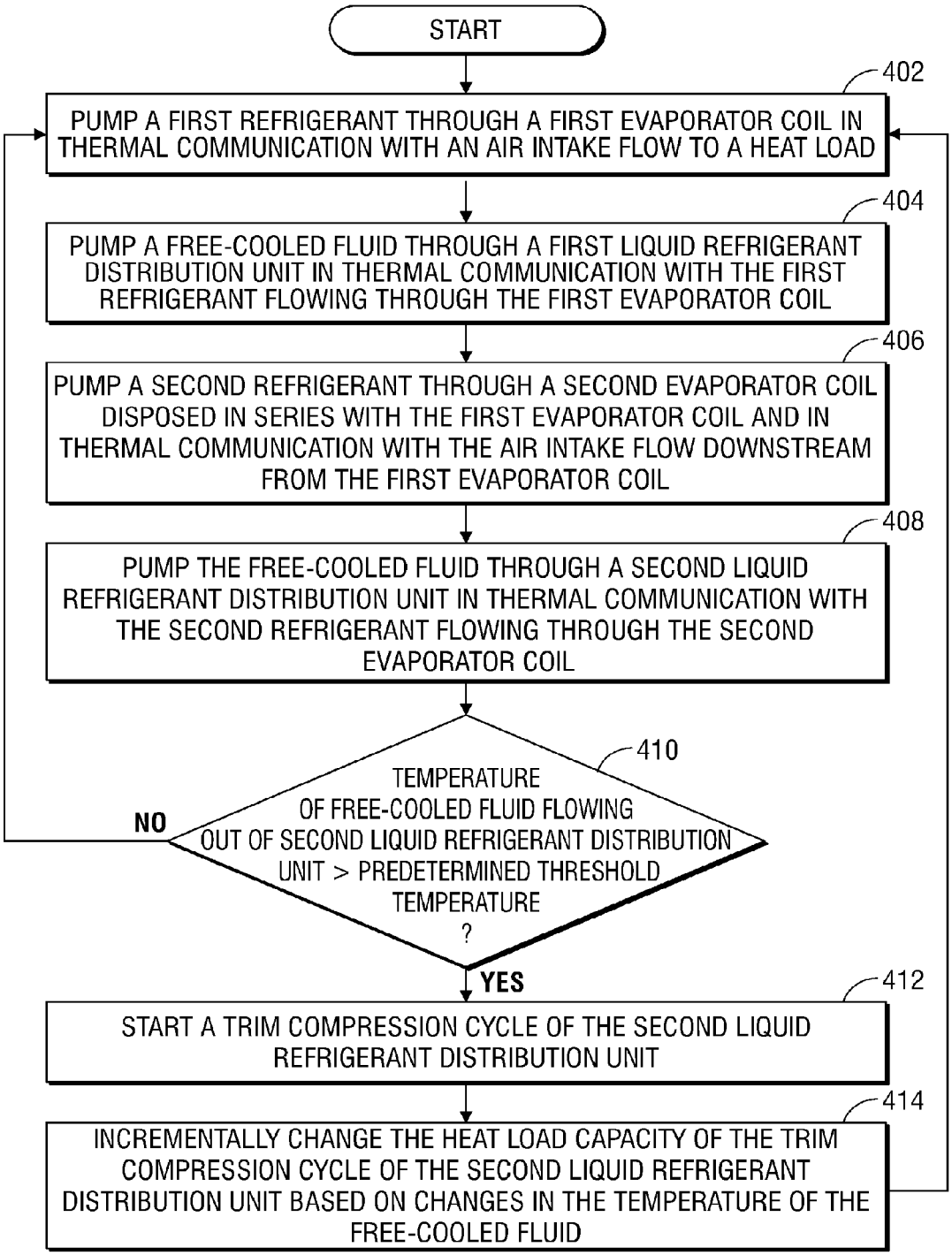
FIG. 4 is a flowchart illustrating a method of operating a dual pumped liquid refrigerant system according to embodiments of the present disclosure.

FIG. 4 is a flowchart illustrating a method of operating a dual pumped liquid refrigerant system according to embodiments of the present disclosure. In step 402, a first refrigerant is pumped through a first evaporator coil in thermal communication with an air intake flow to a heat load. In step 404, a free-cooled fluid is pumped through a first liquid refrigerant distribution unit in thermal communication with the first refrigerant flowing through the first evaporator coil. In step 406, a second refrigerant is pumped through a second evaporator coil disposed in series with the first evaporator coil and in thermal communication with the air intake flow downstream from the first evaporator coil. In step 408, a free-cooled fluid is pumped through a second liquid refrigerant distribution unit in thermal communication with the second refrigerant flowing through the second evaporator coil.

Next, in step 410, it is determined whether the temperature of the free-cooled fluid flowing out of the main condenser of the second liquid refrigerant distribution unit is greater than a predetermined threshold temperature. The predetermined threshold temperature may be determined based upon the temperature of the free-cooled fluid flowing out of the main condenser needed to fully condense the refrigerant flowing through the second evaporator coil back to a liquid. If, in step 410, it is determined that the temperature of the free-cooled fluid flowing out of the main condenser of the second liquid refrigerant distribution unit is not greater than the predetermined threshold temperature, then the method returns to step 402. Otherwise, a trim compression cycle of the second liquid refrigerant distribution unit is turned on, in step 412, and the heat load capacity of the trim compression cycle of the second liquid refrigerant distribution unit is incrementally changed based on changes in the temperature of the free-cooled fluid flowing out of the main condenser of the second liquid refrigerant distribution unit, in step 414. Then, the method returns to step 402.

In some cases, the trim compression cycle of the first liquid refrigerant distribution unit may be turned on and incrementally controlled based on the outside environmental conditions, e.g., the wet bulb temperature, if a component of the second liquid refrigerant distribution unit fails or the trim compression cycle of the second liquid refrigerant distribution unit is unable to cool the air intake flow to a desired temperature because of the outside environmental conditions.

Other applications for the in series pumped liquid refrigerant trim evaporator cycle or system include turbine inlet air cooling, laboratory system cooling, and electronics cooling, among many others.

What is claimed is:

1. A cooling system comprising:

a first evaporator in thermal communication with an air intake flow to a heat load;

a first liquid refrigerant distribution unit in thermal communication with the first evaporator and a first fluid free-cooled by a fluid cooler;

a second evaporator disposed in series with the first evaporator in the air intake flow and in thermal communication with the air intake flow to the heat load; and a second liquid refrigerant distribution unit in thermal communication with the second evaporator and the first fluid free-cooled by the fluid cooler, wherein the first liquid refrigerant distribution unit includes:

a third evaporator in fluid communication with the fluid cooler and configured to enable transfer of heat from the first fluid flowing from the fluid cooler to a second fluid;

a first main condenser in fluid communication with the first and third evaporators and configured to enable transfer of heat from a third fluid flowing from the first evaporator to the first fluid flowing from the third evaporator; and a first trim condenser in fluid communication with the first main condenser and the third evaporator and configured to enable transfer of heat from the second fluid flowing from the third evaporator to the first fluid flowing from the first main condenser, and wherein a trim compression cycle of the second liquid refrigerant distribution unit is configured to incrementally further cool the air intake flow through the second evaporator when the temperature of the free-cooled first fluid flowing out of the second liquid refrigerant distribution unit exceeds a predetermined temperature.

2. The cooling system according to claim 1, wherein the first evaporator is disposed upstream from the second evaporator in the air intake flow.

3. The cooling system according to claim 2, wherein the predetermined temperature is the maximum temperature needed to bring the temperature of the air intake flow out of the second evaporator down to a desired temperature.

4. The cooling system according to claim 1, wherein the first liquid refrigerant distribution unit further includes:

a compressor in fluid communication with a fluid output of the third evaporator and a fluid input of the trim condenser; and an expansion valve in fluid communication with a fluid output of the trim condenser and a fluid input of the third evaporator to form the trim compression cycle.

5. The cooling system according to claim 4, wherein the first liquid refrigerant distribution unit further includes:

a fluid receiver in fluid communication with a fluid output of the first main condenser; and a fluid pump in fluid communication with a fluid output of the fluid receiver and a fluid input of the first evaporator.

6. The cooling system according to claim 1, wherein the first fluid is water, the second fluid is a first refrigerant, and the third fluid is a second refrigerant.

7. The cooling system according to claim 1, wherein the second liquid refrigerant distribution unit includes:

a fourth evaporator in fluid communication with the fluid cooler and configured to enable transfer of heat from the first fluid flowing from the fluid cooler to a fourth fluid;

a second main condenser in fluid communication with the second and fourth evaporators and configured to enable transfer of heat from a fifth fluid flowing from the second evaporator to the first fluid flowing from the fourth evaporator; and a second trim condenser in fluid communication with the second main condenser and the fourth evaporator and configured to enable transfer of heat from the fourth fluid flowing from the fourth evaporator to the first fluid flowing from the second main condenser.

8. The cooling system according to claim 7, wherein the first fluid is a water-based solution, the second fluid is a first refrigerant, and the fourth fluid is a second refrigerant.

9. The cooling system according to claim 7, wherein the second liquid refrigerant distribution unit further includes:

a fluid receiver in fluid communication with an output of the second main condenser; and a fluid pump in fluid communication with a fluid output of the fluid receiver and a fluid input of the second evaporator.

10. The cooling system according to claim 1, wherein the second liquid refrigerant distribution unit includes:

a second main condenser in fluid communication with the fluid cooler and configured to enable transfer of heat from the first fluid flowing from the fluid cooler to a fourth fluid flowing through the second main condenser; and a fourth evaporator in fluid communication with the second main condenser and the second evaporator and configured to enable transfer of heat from a fifth fluid flowing from the second evaporator to the fourth fluid flowing from the second main condenser.

11. The cooling system according to claim 10, wherein the second liquid refrigerant distribution unit further includes:

an expansion valve in fluid communication with a fluid output of the second main condenser and a fluid input of the third evaporator; and a compressor in fluid communication with a fluid output of the third evaporator and a fluid input of the second main condenser to form a second trim compression cycle.

12. The cooling system according to claim 10, wherein the second liquid refrigerant distribution unit further includes:

a fluid receiver in fluid communication with a fluid output of the third evaporator; and a fluid pump in fluid communication with a fluid output of the fluid receiver and a fluid input of the second evaporator.

13. A method of operating a cooling system, comprising:

pumping a first refrigerant through a first evaporator coil in thermal communication with an air intake flow to a heat load;

pumping a free-cooled fluid through a first liquid refrigerant distribution unit in thermal communication with the first refrigerant flowing through the first evaporator coil;

pumping a second refrigerant through a second evaporator coil disposed in series with the first evaporator coil in thermal communication with the air intake flow downstream from the first evaporator coil;

pumping a free-cooled fluid through a second liquid refrigerant distribution unit in thermal communication with the second refrigerant flowing through the second evaporator coil;

determining whether the temperature of the free-cooled fluid flowing out of a condenser of the second liquid refrigerant distribution unit is greater than a predetermined temperature threshold;

turning on a trim compression cycle of the second liquid refrigerant distribution unit if it is determined that the temperature of the free-cooled fluid flowing out of the condenser of the second liquid refrigerant distribution unit is greater than the predetermined temperature threshold; and incrementally increasing a heat load capacity of the trim compression cycle as the wet bulb temperature of the outside environment increases.

14. The method according to claim 13, wherein the predetermined threshold temperature is determined based on the temperature of the free-cooled fluid flowing out of the condenser of the second liquid refrigerant distribution unit that cannot fully condense the second refrigerant back to a liquid.

15. The method according to claim 13, further comprising incrementally changing the heat load capacity of the trim compression cycle of the second liquid refrigerant distribution unit as outside environmental conditions change.

16. A cooling system comprising:

a first evaporator in thermal communication with an air intake flow to a heat load;

a first liquid refrigerant distribution unit in thermal communication with the first evaporator;

a second evaporator disposed in series with the first evaporator in the air intake flow and in thermal communication with the air intake flow to the heat load;

a second liquid refrigerant distribution unit in thermal communication with the second evaporator, wherein the first liquid refrigerant distribution unit includes:

a third evaporator in fluid communication with the fluid cooler and configured to enable the transfer of heat from the first fluid flowing from the fluid cooler to a second fluid;

a first main condenser in fluid communication with the first and third evaporators and configured to enable the transfer of heat from a third fluid flowing from the first evaporator to the first fluid flowing from the third evaporator; and a first trim condenser in fluid communication with the first main condenser and the third evaporator and configured to enable the transfer of heat from the second fluid flowing from the third evaporator to the first fluid flowing from the first main condenser;

a fluid cooler for free cooling a first fluid; and a fluid pump for circulating the first fluid through the first and second liquid refrigerant distribution units, wherein a trim compression cycle of the second liquid refrigerant distribution unit is configured to incrementally further cool the air intake flow through the second evaporator when the temperature of the free-cooled first fluid flowing out of a condenser of the second liquid refrigerant distribution unit exceeds a predetermined temperature.

* * * * *